US005671941A

United States Patent [19]

Girard

[11] Patent Number: 5,671,941

[45] Date of Patent: Sep. 30, 1997

[54] APPARATUS FOR ATTACHING A SHOE TO A GLIDING ELEMENT

[75] Inventor: François Girard, Veyrier Du Lac, France

[73] Assignee: Salomon S.A., Metz-Tessy, France

[21] Appl. No.: 423,156

[22] Filed: Apr. 17, 1995

[30] Foreign Application Priority Data

Apr. 29, 1994 [FR] France ..... 94 05409

[51] Int. Cl.[6] ..... A63C 9/18

[52] U.S. Cl. ..... 280/615; 280/613

[58] Field of Search ..... 280/614, 615, 280/613, 625, 631, 632

[56] References Cited

U.S. PATENT DOCUMENTS

| | | | |
|---|---|---|---|
| 4,836,572 | 6/1989 | Pozzobon | 280/613 |
| 5,007,656 | 4/1991 | Girault et al. | 280/615 |
| 5,207,446 | 5/1993 | Arnulf et al. | 280/615 |

FOREIGN PATENT DOCUMENTS

| | | |
|---|---|---|
| 0243847 | 11/1987 | European Pat. Off. . |
| 2595952 | 9/1987 | France . |
| 2642980 | 8/1990 | France . |
| 2659025 | 9/1991 | France . |
| 2662090 | 11/1991 | France . |

*Primary Examiner*—Brian L. Johnson
*Assistant Examiner*—Michael Mar
*Attorney, Agent, or Firm*—Greenblum & Bernstein, P.L.C.

[57] ABSTRACT

The apparatus for attaching a shoe to a gliding element is adapted more particularly for the practice of skating. It includes a latching mechanism complementary with the latching mechanism borne by the shoe. The latching mechanism are arranged substantially in the area of the metatarso-phallangian journal zone or in front thereof, and are designed so as to allow for release of the shoe beyond a predetermined force being inserted on the latching mechanism, and the apparatus comprises mechanism for blocking the front end of the shoe against the gliding element. According to one embodiment the blocking device of the front end of the shoe are constituted by second latching mechanism which cannot be freed from the shoe and the apparatus.

14 Claims, 2 Drawing Sheets

APPARATUS FOR ATTACHING A SHOE TO A GLIDING ELEMENT

BACKGROUND OF THE INVENTION

1. Field of the Invention

The present invention is related to an apparatus for attaching a shoe to a gliding element such as a cross country ski adapted more particularly for the practice of ice skating steps, but also for ice skates, roller skates, in-line roller skates, or any other element permitting the practice of a gliding sport of the skating type.

It relates more particularly to an attachment apparatus in which the shoe is affixed to the ski or to the gliding element substantially in the area of the metatarso-phallangian journal zone or in front thereof.

2. Description of Prior Art

French Patent 2,642,980 teaches a polyvalent attachment device for a ski constituted by a beam journalled on the ski, on which the shoe is anchored from the front end thereof up to a zone located in front of the metatarso-phallangian journal axis. Such an apparatus assures, by means of the beam, a linkage that is journalled, but rigid in the transverse direction, from the shoe of the ski, and more particularly adapted for the practice of backcountry skiing.

Furthermore, it is provided in this same patent to affix the beam to the ski and only allow rotation of the shoe about a single axis of rotation positioned in front of the shoe, with the aim of practicing cross country skiing itself, whether it be with a classic technique or skating. Such a polyvalent attachment apparatus has proven unfortunately to be of a too complicated, heavy and costly construction. It is furthermore not very adapted to the practice of skating.

It has likewise been proposed, for the practice of skate stepping in cross country skiing or skating, special attachment apparatus maintaining the entire front zone of the shoe up to the metatarso-phallangian journal axis.

Such an attachment apparatus is for example described in French Patent 2,595,952 in the name of the applicant. Such an attachment apparatus with an engagement of the shoe on the ski over the entire front zone until the area of the metatarso-phallangian journal axis provides a better guidance of the ski and a better stability, an increased precision, as well as a good ski/shoe contact and thus a good feel of the snow.

The disadvantage of such an attachment apparatus is the problem of safety in the case of a fall.

Indeed, since the foot of the skier is maintained up to the area of the metatarses, a fall can cause very substantial forces on the portion of the foot that is maintained and give rise in particular to fractures of the toes. The same problem occurs in the other gliding sports of the skating type.

SUMMARY OF THE INVENTION

The aim of the present invention is thus to provide an improved apparatus for affixing a shoe on a gliding element of the skating type that provides an improved safety while being of simple and light design adapted for the practice of gliding sports.

This aim is attained in the apparatus according to the invention which is of the type comprising latching element complementary to the latching element borne by the shoe, in that this latching mechanism is positioned substantially in the area of the metatarso-phallangian journalled zone or in front thereof, and are adapted so as to permit a release of the shoe beyond a predetermined force exerted on this latching mechanism, and in that it comprises a device for blocking the front end of the shoe against the gliding element.

Such an attachment apparatus thus combines the advantages of a gripping or anchoring of the shoe in the area of the metatarses, namely increased guidance, stability, and precision while allowing for a release or disengagement of the latching means and thus an improved safety.

According to one preferred embodiment the blocking device is constituted by a second non-releasable latching mechanism, cooperating with a second latching mechanism of the shoe, this second latching mechanism being positioned in the area of the front end of the shoe.

This embodiment makes it possible to preserve the safety provided by the possibility of disengaging the first latching mechanism, while offering the supplemental safety of avoiding the loss of the gliding element, which:

in competition, allows for a non-negligible time savings;

provides an improved safety with respect to others since one thus prevents the gliding element from escaping on a slope and striking another person.

It should be noted that with the arrangement of the second latching mechanism in the front end zone of the shoe, it is assured that the toes will not be compressed during a fall because of the disengagement of the first latching mechanism, and that a sufficient release of the shoe and is thus obtained.

Advantageously, also the first latching means are designed so as to allow for automatic latching, which allows for a very simple fitting of the attachment, the second latching mechanism arranged in front of the shoe being first engaged mutually and latched, and the first latching mechanism then being latched automatically by a simple downward pressure of the foot.

Preferably, each latching mechanism of the shoe is constituted by a transverse axis and each latching mechanism of the attachment apparatus is constituted by a movable jaw cooperating with one counterjaw for the latching of the associated axis of the shoe.

BRIEF DESCRIPTION OF THE DRAWINGS

At any event, the invention will be better understood and other characteristics thereof will become clearer by means of the attached description which refers to the annexed schematic drawings in which.

A DETAILED DESCRIPTION OF THE INVENTION

Figure 1:
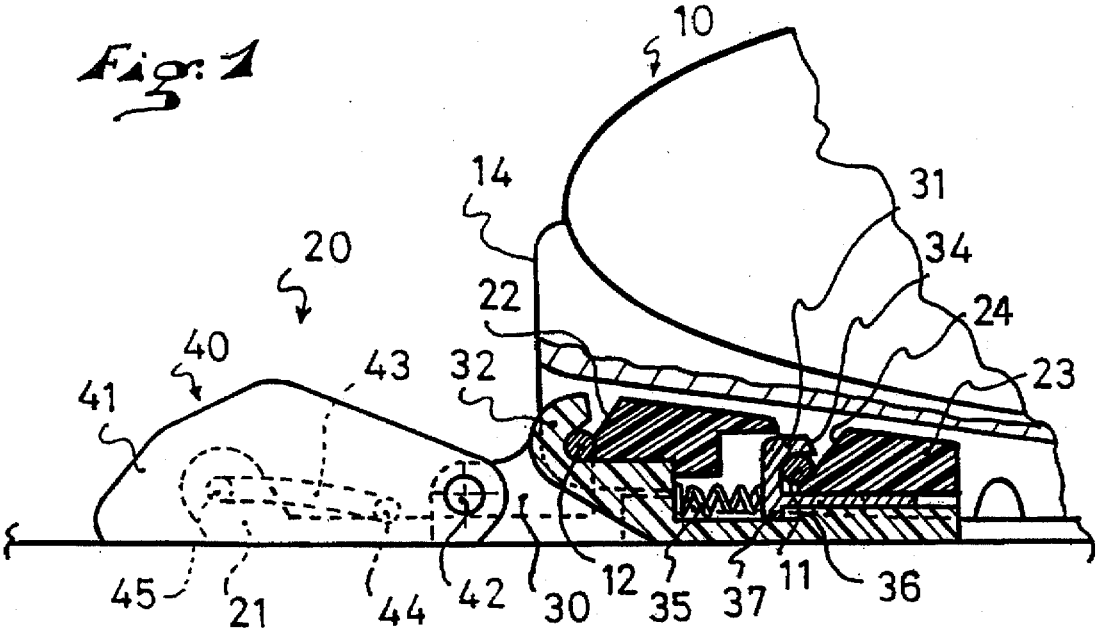
FIG. 1 is a partial sectional view of an attachment/shoe assembly according to a first embodiment.
Figure 2:
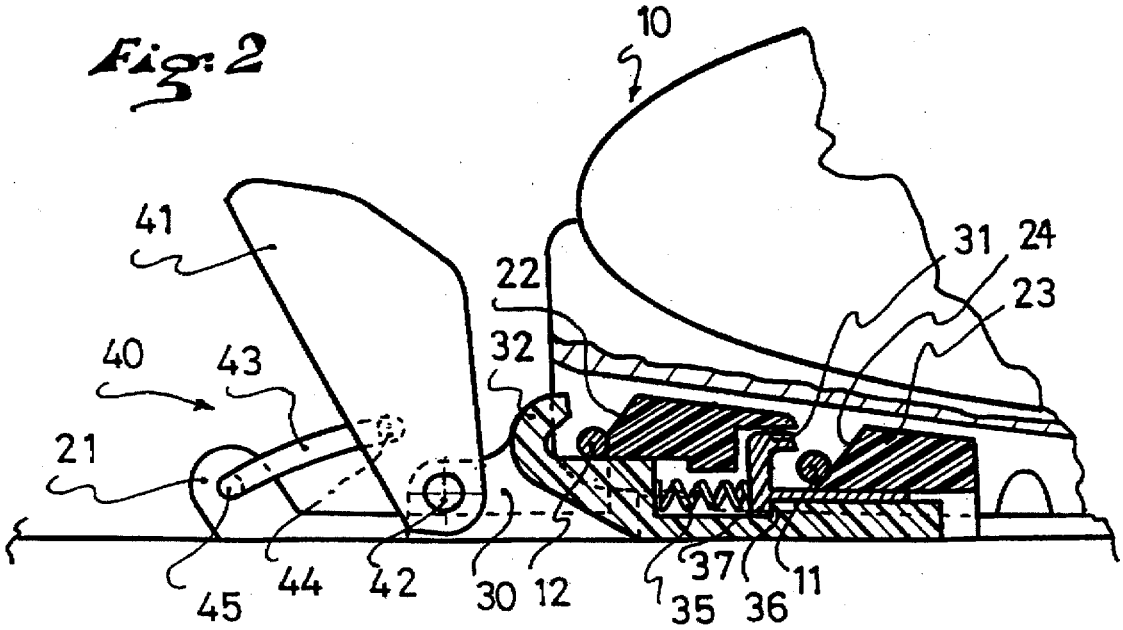
FIGS. 2 and 3 are views similar to FIG. 1 showing the attachment apparatus respectively in the open and disengaged positions.
Figure 3:
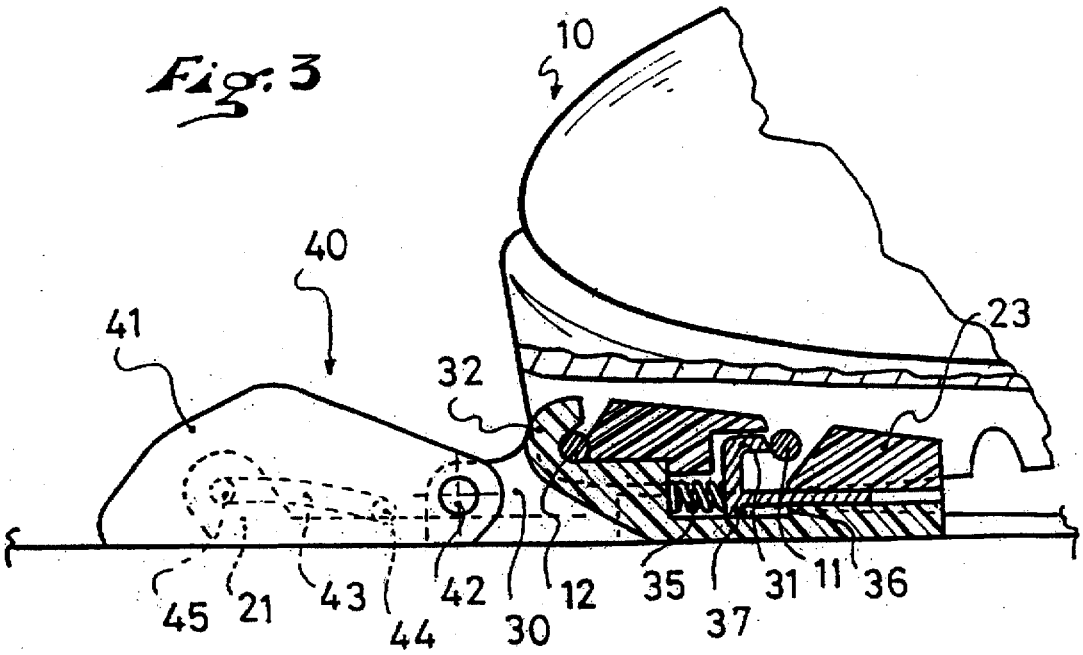

FIGS. 1–3 illustrate the use of an attachment apparatus with an associated shoe 10 comprising two transverse latching pins of axles 11 and 12 positioned, the one 11, substantially in the area of the metatarso-phallangian journal zone, and the other 12, at the front end of the shoe. According to one preferred embodiment, the latching pin 11 is positioned in a zone located between about 30 and 60 millimeters at the rear of the front end 14 of the shoe.

The attachment apparatus 20 is constituted essentially by a base 21 adapted to be affixed to a ski or any other gliding element, and by a latching carrier 30 controlled by a latching system 40.

The latching carrier 30 is longitudinally displaceably mounted (in a manner not shown in the drawings) on base 21. Its displacement is controlled by a lever 41 which is journalled at 42 on this latching carrier and connected to the base 21 by means of a U-shaped wire spring 43. This wire spring 43 is journalled at each of its ends 45 to the latching lever 41 and to base 21 through its median portion 43.

The spring 43 and lever 41 assembly constituting a knuckle joint locking system whose axes are constituted by the journal axes 42, 44, 45, the two axes 42 and 45, defining the dead point of the knuckle joint.

In a manner known in itself, the locking of the knuckle joint is obtained when the journal axis defined by 44 passes beneath the line of the dead point defined the axes 42 and 45.

The latching carrier 30 comprises two hooks 31 and 32 having substantially the form of a C open towards the rear.

Each of the hooks 31 and 32 cooperates in the manner of a jaw/counterjaw with a fixed support surface 22, 24, respectively, for latching of a respectively associated pin 11 and 12 of the shoe.

As is seen in the figures, the support surface 22 has a vertical portion that engages pin 12, whereas the support surface 24 has a slight slope, so as to allow for a release of pin 11 as will be seen below. These two support surfaces 22 and 24 are formed on a fixed portion 23 affixed to the base 21. The hook 31 also comprises a slight ramp 34 forming with the support surface 24 a sort of V allowing for automatic insertion of the shoe.

Hook 32 is affixed to the latching carrier 30, while the hook 31 is displaceably mounted in the longitudinal direction on this carrier 30.

A spring 35 constantly biases hook 31 towards the rear of the attachment, i.e., in the direction of the support surface 24, in the latching position of pin 11.

Furthermore, the latching carrier 30 comprises a vertical shoulder 36 adapted to cooperate with a vertical projection 37 of hook 31 to drive hook 31 into the unlatched position of pin 11 during forward displacement of the carrier.

FIGS. 2 and 3 illustrate the operation of the attachment apparatus of FIG. 1.

In the open position, illustrated in FIG. 2, the latching lever 41 is pivoted upwardly, about its axis 42 and translationally drives carrier 30 in the direction opposite to the support surfaces 22 and 24, i.e., towards the left in the figure.

It will be noted that in this opening movement the movable hook 31 is likewise driven by the carrier 30 by means of shoulder 36 cooperating with projection 37 of this hook.

The two hooks 31 and 32 then demarcate, with the support surfaces 22 and 24, housings that are adapted to receive the two latching pins 11 and 12 of the shoe. Once these pins 11 and 12 are in place in their associated housings, one need only pivot lever 41 downwardly, i.e., in the clockwise direction, to push the carrier 30 back in the latching position shown in FIG. 1, each of hooks 31 and 32 coming to latch the associated pins 11 and 12 of the shoe against the associated support surfaces 22 and 24 respectively.

As explained previously, a reliable latching of the pins is then obtained by the knuckle joint system 41, 43.

In the event of an excessive force on the pins 11 and 12, and particularly in the vertical direction, for example in the case of a fall, the pin 11 can slide upwardly along ramp 24 by pushing the movable hook 31 frontwardly until it is freed from its housing, as shown in FIG. 3. This release upon the exertion of a force beyond a predetermined magnitude can be considered automatic, compared to the manual latching and unlatching of the pin 12.

At this point in time, the shoe can then pivot freely about the front pin 12, without risk of injury for the user. The possibility of freeing the rear pin 11 of the shoe, thus makes it possible to increase the safety of the user.

Furthermore, as the front pin 12 remains latched, the gliding element is not lost and does not risk escaping and wounding another person.

This permanent latching of the front pin 11 likewise allows for an easier reinsertion of the shoe.

Indeed, the associated ramps 34 and 24 of hook 31 and of its support surface, as well as the elastic mounting of hook 31 allows for an automatic latching of the rear pin 11 by simply introducing the latter in the V for shoe insertion demarcated by the ramps and by exerting a vertical force on pin 11 until hook 31 is pushed back frontwardly and pin 11 introduced in its housing.

Figure 4:
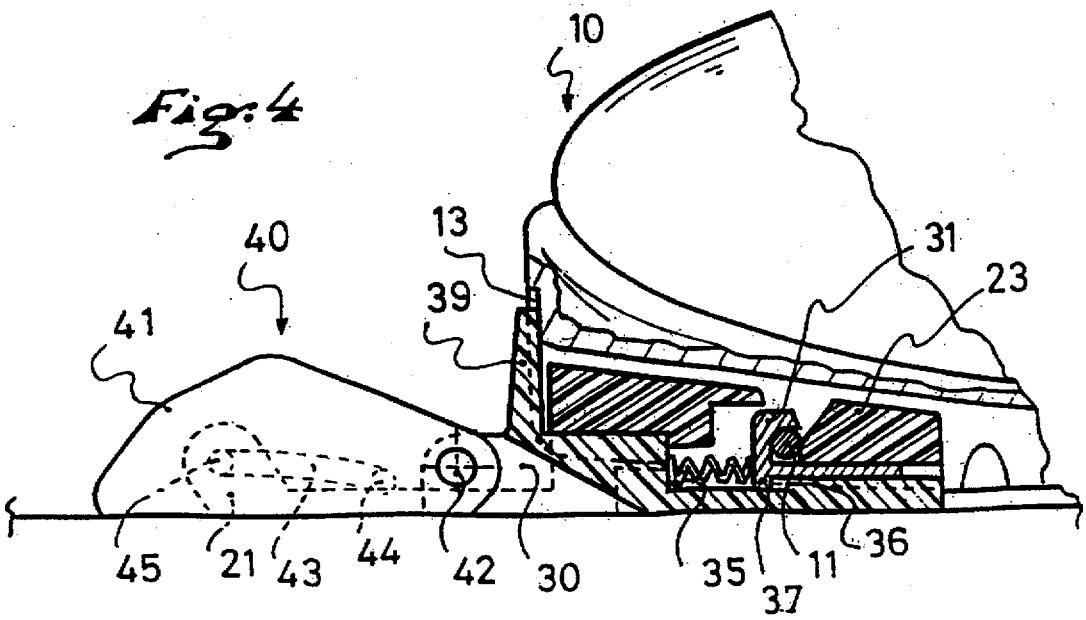
FIG. 4 is a view similar to FIG. 1 of an attachment/shoe assembly according to a second embodiment.

The embodiment of the invention shown in FIG. 4, distinguishes itself from the preceding example by the replacement of the front pin 12 and of the associated latching hook 32 by a vertical support surface 13 of the shoe and an associated vertical abutment 39 of the latching carrier such that the shoe is only latched by its rear pin 11.

All the other elements are designated by identical references.

The abutments 13 and 39 cooperate together to assure a blocking of the front end of the shoe against the gliding element and to guarantee a contact without play of the shoe therewith over the entire front of the shoe.

These vertical abutments 13 and 39 may likewise be replaced by horizontal abutments, for example, between the lower surface of the shoe and the upper surface of the carrier of the attachment apparatus.

With respect to such a solution, the vertical abutments have the advantage of not being subjected to problems of wear and tear.

The vertical abutment 39 can likewise be made of an elastic material so as to compensate for the inevitable manufacturing clearances.

It will likewise be noted that the pin and hook latching systems described can be replaced by any equivalent latching system.

However, the latching system of the hinge type described is preferred since it allows for an easy rotation of the shoe about the pin 12 in the case of the latching of pin 11 during a fall. In a general sense, i.e., for both of the above-described embodiments, the front latching or blocking mechanism can be referred to as an engagement mechanism.

The present application claims the priority of French Patent Application No. 94.05409, filed Apr. 29, 1994, the description of which is hereby incorporated a reference thereto.

Finally, although the invention has been described with reference to particular means, materials and embodiments, it is to be understood that the invention is not limited to the particulars disclosed and extends to all equipment within the scope of the claims.

What is claimed:

1. An apparatus adapted to be affixed to a gliding element and for attaching a shoe to the gliding element for the practice of a gliding/skating sport, said apparatus comprising:

a latching mechanism including a latching element adapted to be carried by the gliding element and adapted for latching cooperation with a complementary element borne by a shoe, said latching element being positioned substantially in an area corresponding to the metatarso-phallangian journal zone of a foot;

an engagement mechanism including an engagement element adapted to be carried by the gliding element and adapted for engagement cooperation with an element borne by the shoe at a front end of the shoe, said engagement element being positioned forwardly of said latching element and in an area corresponding to a front end of the shoe;

wherein said latching mechanism and said engagement mechanism attach the shoe to the gliding element along a zone extending from said front end of the shoe to substantially the area of the metatarso-phallangian journal zone; and wherein said latching mechanism includes a device allowing release of the complementary element from said latching element in response to an exerted force beyond a predetermined magnitude by the shoe on the latching element.

2. An apparatus according to claim 1, wherein:

said engagement element is an abutment adapted to engage a complementary abutment at the front end of the shoe for blocking the front end of the shoe with respect to the gliding element.

3. An apparatus according to claim 2, wherein:

said abutment is defined by a vertical support surface adapted to engage a complementary vertical support surface of the shoe.

4. An apparatus according to claim 1, wherein:

said device of said latching mechanism is operative to automatically release the shoe at the area of the metatarso-phallangian journal zone; and said engagement mechanism comprises a second latching mechanism, said second latching mechanism comprises a device latching the front end of the shoe against automatic release.

5. An apparatus according to claim 1, wherein:

said engagement mechanism is positioned in an area corresponding to 30 to 60 millimeters rearward of the front end of the shoe.

6. An apparatus according to claim 1, in combination with a shoe bearing said complementary element and said engagement element.

7. An apparatus according to claim 1, in combination with the shoe, wherein:

said complementary element of the shoe and said engagement element of the shoe is each constituted by a transverse pin.

8. An apparatus and shoe according to claim 7, wherein:

each of said latching mechanism and said engagement mechanism comprises a jaw adapted to be mounted for movement with respect to the ski and a counterjaw adapted to be fixed with respect to the ski for latching of a respective one of said transverse pins.

9. An apparatus and shoe according to claim 8, wherein:

said apparatus further comprises a carrier adapted to be mounted for longitudinal displacement with respect to the ski; and each said jaw is mounted upon said carrier.

10. An apparatus and shoe according to claim 9, further comprising:

a knuckle joint latching system for locking said pins in said jaws and counterjaws.

11. An apparatus and shoe according to claim 9, wherein:

said jaw of said latching mechanism is mounted for longitudinal displacement with respect to said carrier, said latching mechanism further comprises an elastic biasing member that is positioned to bias said jaw to a latching position.

12. An apparatus and shoe according to claim 9, wherein:

said latching mechanism further comprises a device mounted for longitudinal displacement with respect to said carrier that drives said jaw of said latching mechanism to said latching position.

13. An apparatus and shoe according to claim 11, wherein:

said jaw of said latching mechanism comprises a ramp.

14. An apparatus and shoe according to claim 13, wherein:

said counterjaw of said latching mechanism comprises a second ramp, said ramp and said second ramp being positioned to define a V for guiding insertion of said pin into a latching position.

* * * * *